United States Patent [19]

Kohaut

[11] 4,170,853

[45] Oct. 16, 1979

[54] INSERT VOID FORMING DEVICE

[75] Inventor: John E. Kohaut, West Orange, N.J.

[73] Assignee: Raceway Components, Inc., Nutley, N.J.

[21] Appl. No.: 838,089

[22] Filed: Sep. 30, 1977

[51] Int. Cl.[2] ..... E04B 1/38

[52] U.S. Cl. ..... 52/99; 52/100; 52/699; 249/35; 249/63; 249/177

[58] Field of Search ..... 52/98–100, 52/699–701; 249/61, 177, 35, 63

[56] References Cited

U.S. PATENT DOCUMENTS

| | | | |
|---|---|---|---|
| 1,391,988 | 9/1921 | Zents | 249/177 X |
| 1,954,788 | 4/1934 | Chambliss, Jr. et al. | 249/61 |
| 2,234,784 | 3/1941 | Stolz | 249/35 X |
| 2,249,824 | 7/1941 | Hall | 249/177 |
| 2,270,286 | 1/1942 | Gerriets | 52/577 X |
| 2,684,518 | 7/1954 | Whitlock | 249/177 X |
| 2,694,847 | 11/1954 | Christiansen | 249/61 |
| 2,780,936 | 2/1957 | Hillberg | 52/699 X |
| 3,265,349 | 8/1966 | Hamrick | 249/177 |
| 3,276,176 | 10/1966 | Jonsson et al. | 52/577 X |

*Primary Examiner*—Alfred C. Perham
*Attorney, Agent, or Firm*—Sommers & Sommers

[57] ABSTRACT

This invention relates to a device for forming a pre-set void in a floor, wall or other structural member, to thereby define an essentially integral spatial void or closure therein, which maintains the UL fire rating of the floor or other structural member in which it is positioned, and which may be readily removed, when desired, to define the void, without use of special tools or procedures. The device is useful for defining modular or other openings to receive, for example, insert devices, through which cables, such as power and telephone lines, may be passed from a source, for connection with fixtures, phones and other devices. The device is adapted to be secured to forms, for example so that a material such as cement or other floor, wall or other structural forming materials may be positioned or poured thereon and therearound; the device in such cases may form a preset-sealed part of the structural member, readily available for opening when desired.

15 Claims, 7 Drawing Figures

FIG. 1
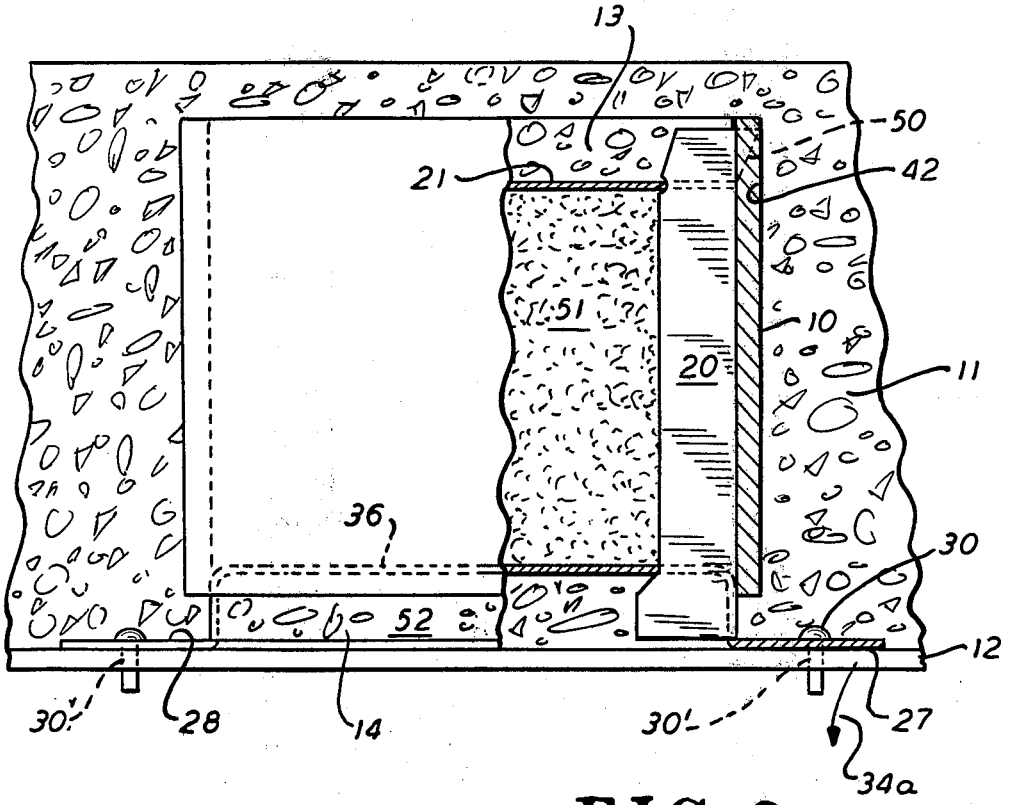
FIG. 2
FIG. 1A
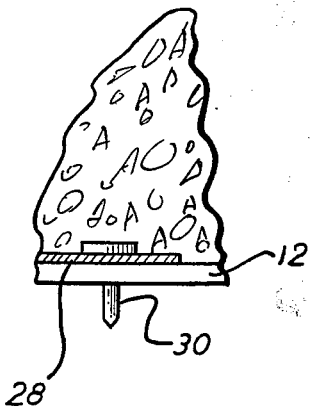
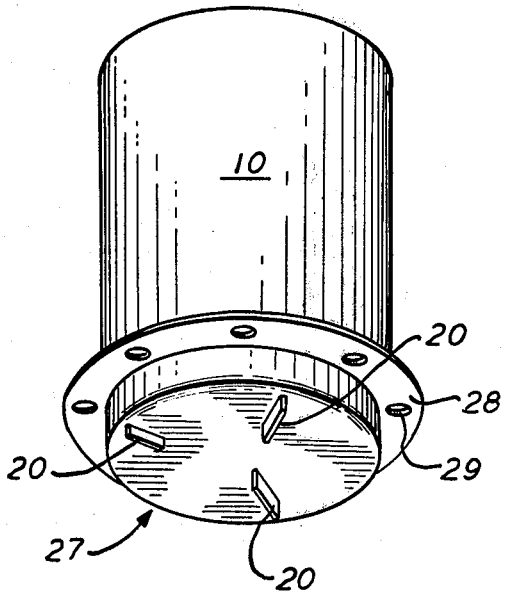

INSERT VOID FORMING DEVICE

BACKGROUND OF THE INVENTION

This invention relates to an opening forming device which may be used to provide modular or other pre-set and later readily locatable, cable passage openings in poured or otherwise formed materials on a planar deck or other support, forming a floor, wall or other planar structural member. The device has features enabling it to be thus readily activated to leave openings or voids in the structural member at desired stations, for positioning articles therein, and is adaptable for use in numerous applications-for example, and without limitation thereto, in connection with building procedures, to provide voids, for example, at precalculated spaced intervals, while maintaining the UL rating of the structural member at all times.

The device is adapted for use, for example, in building construction wherein it is desired to provide openings which may be selectively activated to receive electrical insert devices for connection of cables in or passed through the building wall, floor, raceways, etc., for connection with accessory devices. It has heretofore been necessary, in such cases, to drill holes in the structural member to receive inserts or other devices. In some cases, miscellaneous objects readily at hand such as tin cans, etc. were secured to deck forms and the material poured therearound. Such random, unreliable, haphazard, inaccurate inprovisations and expedients, resulted in reduction of Underwriters' Laboratory ratings; objects such as tin cans, being heat conductors, lowered the heat resistance ratings which would otherwise apply to a concrete or other floor; furthermore, such prior improvisations were unpredictable, unreliable and impractical, time-consuming, awkward and costly and inaccurate, and entailed delay.

OBJECTS OF THE INVENTION

The structure of the present invention obviates disadvantages of prior art devices and practices by providing a void forming device which is not a conductor of heat and which may be secured to forms and material poured therearound and thereover, and which maintains the UL rating. The builder, contractor, or other person desiring to install electrical insert devices in the floor or other building structure can then remove the pre-set void forming devices of this invention in a fraction of the time required in use of other expedients, while achieving the desired end rapidly, accurately, and at extremely low cost and assuring clean-cut, precise, pre-set voids. The device of this invention, in contrast to the inaccuracy and other disadvantages of expedients heretofore used in the art, maintains the UL fire rating of the floor or other building structure in which it is positioned, and can be located, as void-forming modules, at predetermined intervals in the structure, readily locatable by use of magnetic locators, mathematical claculation or otherwise, for removal, by the average workmen, using convenient tools at hand. The accuracy of voids so formed is predictable and uniform, and while substantial time savings effectuated; the need for drilling holes is obviated. The device of the invention may be made at low cost, making it practical as a module for use in multiples which when so desired, may be knocked out of the building structures at the locations desired such as desk and other cable connection or appliance stations.

DESCRIPTION OF THE DRAWINGS

Embodiments of the invention are illustrated, by way of example, in the accompanying drawings, wherein similar reference characters indicate like parts, and wherein:

FIG. 1 is a vertical elevational, partly sectional, view, showing a device of the invention installed in a building structure, FIG. 1A is a fragmentary elevational, partly sectional, view, showing use of another type of fastener to secure the device of the invention to a floor deck form, FIG. 2 is a perspective view of another form of said device.

DESCRIPTION OF FORMS OF THE INVENTION

Structural members to which this invention relates are, for example, floor, wall and other constructions utilizing plastic, wood or steel deck forms, onto which material, such as cement, may be poured or otherwise formed; the deck forms may be later stripped away, for reuse. The word "floor" as used in this specification and claims, shall be deemed to also include walls and other structural parts. The device of the invention may be conveniently installed and secured to the deck 12 from the top of the deck.

Figure 3:
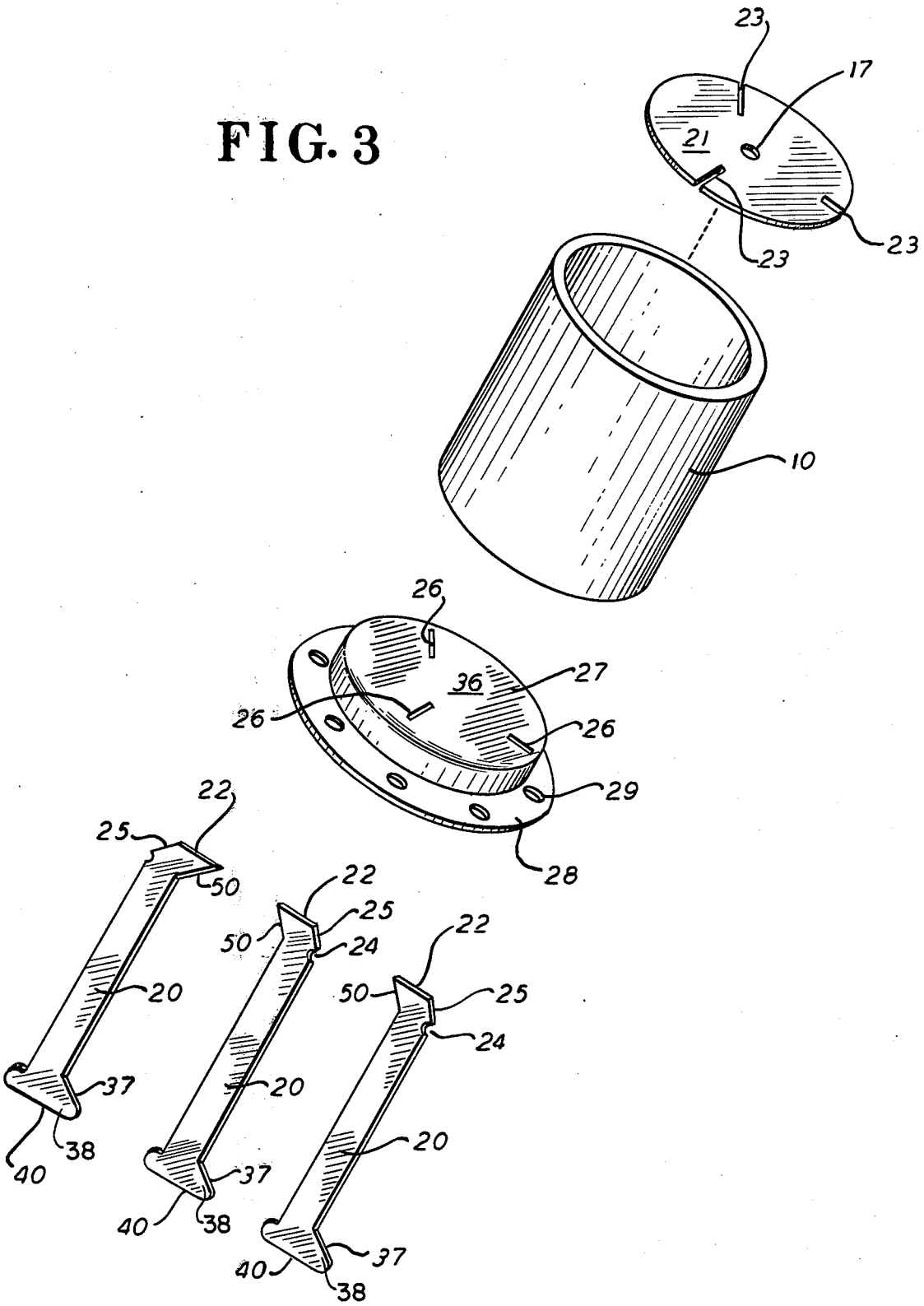
FIG. 3 is an exploded, perspective view of parts of the device.
Figure 4:
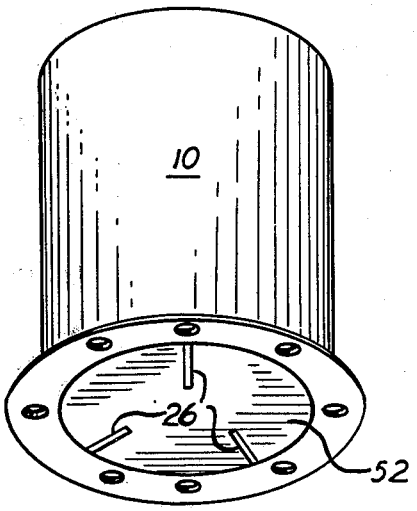
FIG. 4 is a perspective view thereof, assembled.

A form of the invention is shown in FIG. 3 to comprise an elongated tubular body member 10, preferrably of slightly less axial length than the height of the floor or other area 11 in which the device is to be encapsulated and struts 20, a top cap or plate 21 and a bottom cap or plate 27 having a marginal portion 28 provided with apertures or slots 29 therein for passage therethrough of any desired or convenient fastening means suitable for securing the device to the deck form 12 (FIGS. 1, 1A, 5, 6) in connection with which the invention is used. The deck form 12 may be for example, of plastic (FIG. 1), steel (FIG. 5) wood (FIG. 6) or other material or combinations thereof.

The device may be secured to a plywood form for example, (FIGS. 1, 1A, 6) by passing nails 30 or the like therethrough or to steel or other forms (FIG. 5) as by providing apertures in said forms to receive fasteners 34 of suitable form to connect the parts. After setting of the material 11, the form may be stripped away, as in the direction of arrow **34*a* (FIG. 1) and the form 12 may then be reused as desired. Where the deck form 12 is a steel deck, as in FIG. 5, the contractor or builder drills or otherwise forms an aperture 41 therein and drops the device 10 therein; the floor forming material 11 may then be poured around member 10. Similarly, if metal forms are used in the building construction, plate 27 (FIG. 2) may be welded to the form as at 44 (FIG. 5), instead of or in addition to rivet or other fasteners 34**.

The marginal ring portion 28 (FIGS. 2,3) of member 10 is provided with connector receiving apertures 29 therein through which pins, rivets, or screws pass to secure member 10 to deck 12. The exemplary descriptions herein of fastening means is not intended to in any limit use of the invention thereto, those recited herein being exemplary of an infinite variety of fastening means and procedures which may be used. Marginal ring portion 28 is further (FIG. 5) provided with suitably formed knock-out defining marginal portions 42 defining knock-out medial portion 43. To activate member 10 of FIGS. 2 and 5, the contractor or builder may punch through device 10, driving through knock-out medial portion 43.

In practice, the void forming device 10 (FIGS. 2, 3) is prefilled, prior to being secured to deck 12, with mineral wool or any other desired or convenient material; for example, concrete 51 and grout 52 may (FIG. 1) be inserted into body 10 on initial assembly.

The FIG. 3 form of invention comprises elongated body member 10, which may be of cardboard or other material and may, for example, be square or otherwise formed hollow or tubularly, and a conforming top cap plate 21, bottom plate 27, and intermediate struts 20, made of metal or other material harder than body member 10. The intermediate struts are preferably at their upper ends 22 (FIG. 3) tapered or angularly pointed as at 25 to facilitate interlocking of the parts on assembly (FIG. 1) and are preferably further formed with marginally recessed portions 24 for (FIG. 1) registration with the inner closed ends of the marginal slots 23 of top cap plate 21. The upper offset end portions 50 (FIG. 3) opposite the slots 24, cut into the body member 10 (FIGS. 1–5) to interlock the parts on assembly. The lower ends 40 of struts 20 are provided with offset tapered T-shaped (FIG. 3) head 38 portions 37 overlying and in registration (FIGS. 1 and 3) with marginal slots 26 formed in medially offset portion 36 of the bottom plate 27.

The device may be assembled in a suitable jig or fixture, the struts 20 being passed through body member 10 and received in the slots 23,26, respectively, of the upper and lower plates, and interlocking with said plates and with the body member 10; the latter, as above noted, is preferably of cardboard or other material softer than the struts. The struts and top cap plate 21 and bottom plate 27 may be of metal or other relatively hard material, to cut into the body member 10 frictionally, firmly registering the parts. The device may be assembled and secured to the form 12 with the hat-shaped lower cap 27 positioned, as shown in FIGS. 1 and 3, with the medially offset portions 26 thereof uppermost, or as shown, in FIGS. 2 and 5, with said cap inverted.

The parts, assembled, as above described, are secured to the deck forms 12 and the devices are then encapsulated and surrounded (FIG. 1) in the structural material 11 as it is poured. Some of the material will be disposed in the recessed portions 13,14 (FIG. 1) at the top and bottom of the assembled device. The quantity of material in top recess 13 may be chipped away when it is desired to clear the device from the floor, etc., to leave a void therein for insertion of electrical insert or other devices. The top plate 21, for that purpose may be rapidly removed by tool or other simple means. If desired, an opening or slot 17 (FIG. 3) may be provided in the top cap plate 21 to facilitate the removal procedure (FIG. 3).

On removal of the cap 21, the remaining parts of the device may be readily collapsed and pushed downwardly and out of the floor or other material 11, form 12, having been previously stripped or removed therefrom, in the FIG. 1 form. The desired void is readily and accurately formed by any simple procedure, as by striking the device from the top with a bar and hammer; body member 10 and associated parts drop through the stripped deck and out of floor member 12. The void thus formed in the floor 11 is of essentially the diameter of the body member 10, accurately meeting the requirements for insert devices, etc. to be placed therein.

Figure 5:
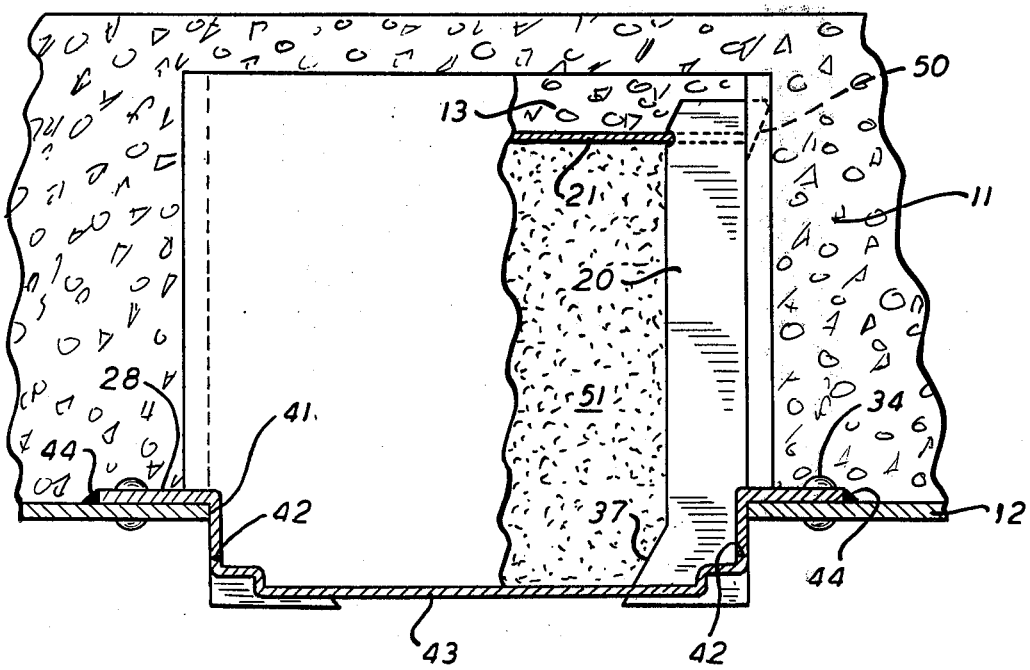
FIG. 5 is a vertical elevational, partly sectional, view of the device, shown positioned in a floor on a support deck form whereon material has been poured, encapsulating the device therein.
Figure 6:
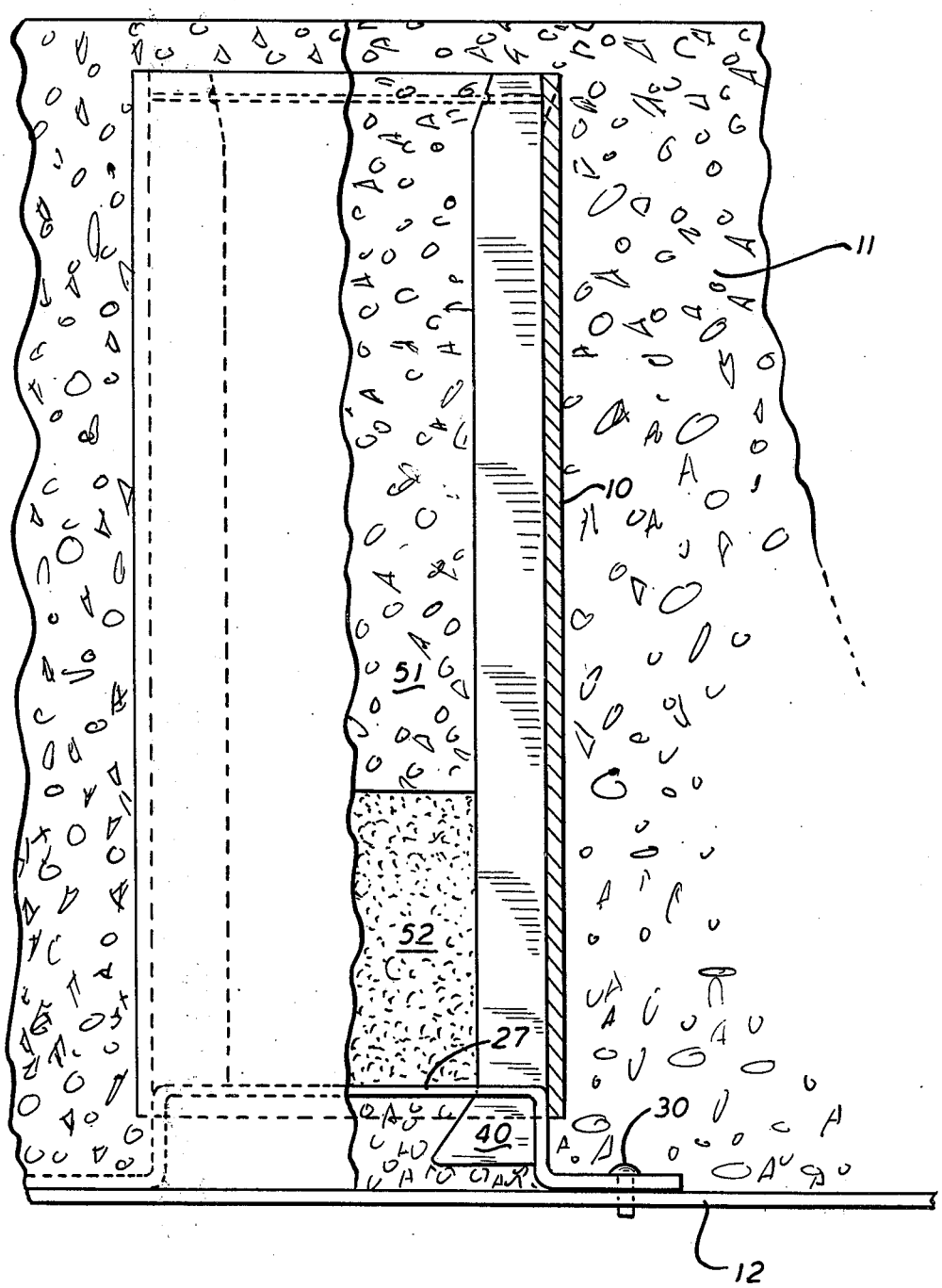
FIG. 6 is a vertical, elevational, partly sectional, view of said device, shown secured to a stripaway deck form.

The device, in the form shown in FIGS. 6 and 7, contains parts corresponding to those similarly numbered and previously described, for use in connection with walls etc., of structural material 11 of greater depths than in the form of FIGS. 1 and 5.

The invention has been exemplified above in exemplary embodiments thereof. Other embodiments made, within the scope and spirit of the invention and the claims appended, shall be deemed to be within the spirit and scope of the invention and covered thereby.

I claim:

1. A void forming device for use in forming a void in a structural member such as a floor, formed of material therearound, said device comprising:

(a) an elongated tubular member, (b) a cap plate for positioning at the upper portion of said tubular member, (c) a bottom plate proportioned for positioning at the lower portion of said tubular member, (d) said cap plate and bottom plate being provided with slots defining flat, elongated openings therein, (e) flat, elongated struts proportioned to be positioned in the tubular member between the cap plate and bottom plate, and tubular member, (f) said struts having opposite ends formed complementarily to said cap plate and bottom plate slots for interlocking therewith, thereby connecting said cap and bottom plate, whereby the device will form a barrier void around which the structural member may be formed and defining a void in said structural member and whereby, when said device is removed, an electrical insert device may be positioned in said void.

2. In a void forming device as set forth in claim 1, said tubular member having an axially elongated plane and being of readily compressible material, and said struts being formed of relatively more rigid material, and said top plate being formed of relatively rigid material and being provided with an outer marginal edge and with slots closed at their inner ends and opening at said marginal edge, into which the struts may positioned, the upper ends of the struts being formed to complementarily telescopically receive and so engage the top plate slotted portions, the parts being so proportioned that said struts will also engage the tubular member, thereby assembling the void forming device.

3. In a void forming device as set forth in claim 1, wherein said structural member is so formed on a deck form, and means engageable with said bottom plate and deck form for securing said device to said form.

4. In a void forming device as set forth in claim 1, said bottom plate being formed with a portion medially offset therefrom and defining a hat-shaped contour.

5. In a void forming device as set forth in claim 1, said bottom plate being formed with slots, the parts being proportioned so that the struts received in said slots, engage the tubular member, thereby securing the parts together.

6. In a void forming device as set forth in claim 1, said struts being formed with recessed portions to frictionally engage the top plate when the struts are so received in the slots in the top plate, thereby registering the parts.

7. In a void forming device as set forth in claim 1, said struts being formed with offset portions for registration engagement with the bottom plate.

8. In a void forming device as set forth in claim 1, said struts being provided with said recessed portions for so engaging the cap plate at one end and being provided, at the other end, with offset head portions for engaging with the bottom plate.

9. In a void forming device as set forth in claim 1, said tubular member being made of a readily compressible material such as cardboard.

10. In a void forming device as set forth in claim 1, said struts being so proportioned relative to the tubular member that, on engagement of the struts with the top cap and bottom plate, said top plates will be disposed inwardly of the end of the top of the tubular member, so that the structural member forming material may extend inwardly of the top of the tubular member and onto the top plate.

11. In a void forming device as set forth in claim 1, said struts being formed at one end with offset portions for engagement with said body member.

12. In a void forming device as set forth in claim 1, said struts being formed with portions at their upper and lower ends for frictionally engaging the top and bottom plates, to thereby register the parts.

13. In a void forming device as set forth in claim 1, said struts being formed with recessed portions at their upper and lower ends for frictionally receiving the top plates and bottom plates, and thereby registering the parts.

14. In a void forming device as set forth in claim 1, said bottom plate being formed with a knock-out portion.

15. In a void forming device as set forth in claim 1, the ends of said struts so interlocking with the bottom plate slots being of T-shaped form and proportioned to overlie the bottom plate slots when said struts so interlock with the bottom plate.

* * * * *